US005570517A

United States Patent [19]

Luker

[11] Patent Number: 5,570,517

[45] Date of Patent: Nov. 5, 1996

[54] SLURRY DRYER

[75] Inventor: William A. Luker, Burnsville, Minn.

[73] Assignee: Scott Equipement Company, New Prague, Minn.

[21] Appl. No.: 387,442

[22] Filed: Feb. 13, 1995

[51] Int. Cl.[6] ..... F26B 7/00

[52] U.S. Cl. ..... 34/424; 34/435; 34/487; 34/507; 34/136; 34/527; 34/586; 34/593; 34/599; 366/102

[58] Field of Search ..... 34/60, 185, 186, 34/187, 135, 136, 527, 583, 586, 593, 595, 599, 372, 400, 424, 425, 435, 487, 499, 507; 110/226, 246; 366/101, 102, 103, 106, 107, 144

[56] References Cited

U.S. PATENT DOCUMENTS

| | | | |
|---|---|---|---|
| 2,460,008 | 1/1949 | Heller | 34/136 X |
| 2,857,612 | 10/1958 | Fischer | 34/185 |
| 4,940,334 | 7/1990 | Musil | 34/136 |
| 5,136,791 | 8/1992 | Fraile et al. | 34/586 |
| 5,271,163 | 12/1993 | Pikus et al. | 34/499 |

FOREIGN PATENT DOCUMENTS

| | | | |
|---|---|---|---|
| 3317572 A1 | 11/1983 | Germany | F26B 11/16 |

OTHER PUBLICATIONS

Scott Continuous Process Equipment brochure (6 sides).
Scott ASM Fine Grinder (2 sides).
Scott's New Cooler System brochure (2 sides).
Scott A.S.T. Dryer (2 sides).
Publication occurred in the United States (New Prague, Minnesota).

*Primary Examiner*—John M. Sollecito
*Assistant Examiner*—Steve Gravini
*Attorney, Agent, or Firm*—Faegre & Benson LLP

[57] ABSTRACT

An improved slurry dryer of the type having a plurality of beater blades carried on a rotating shaft in a cylindrical housing, the improvement in combination therewith of a plurality of scraper blades mounted on at least one disk carried by the rotating shaft at the inlet end of the dryer for scraping the cylindrical side wall and the end wall to prevent the material entering the dryer from adhering and remaining on the side and end wall of the cylindrical housing. The scraper blades are replaceable and adjustable with respect to the side and end walls of the housing by slotted mounting to accommodate wear of the scraper blades. An air dam in the form of a radially extending disk is provided downstream of the scraper blade disks to direct drying air radially outward to impinge on the slurry material to be dried.

24 Claims, 6 Drawing Sheets

SLURRY DRYER

BACKGROUND OF THE INVENTION

This invention relates to the field of heavy duty continuous flow material processing equipment, more particularly continuous co-flow dryers for reducing the moisture content of slurries and similar materials. As used herein, "slurry" means a flowable or pumpable mixture of a liquid and one or more insoluble materials, typically with a high liquid-to-solid ratio. Most often the liquid is water. Examples of such slurries include meal processing such as meat, fish, or feather meal processing, soybean meal processing, and non-meal material processing such as ceramic slurry processing, and sewage or waste treatment processing. It is to be understood that the term "co-flow" refers to a design in which the air and material flow in the same direction in the dryer, in contrast to "counter-flow" designs, for example.

In the past, co-flow dryers were capable of drying slurries up to only about 60% moisture in a single pass without adding dry powder to the material to be dried.

The present air swept tubular dryer invention overcomes shortcomings of prior drying machinery, extending the range of slurries capable of being dried (in a single pass) up to about 90% moisture (or more), while continuing to provide the advantages of continuous flow drying, contrasting especially with rotary drum dryers and fluidized bed dryers which are typical of other continuous drying processes which differ from the process of the present invention in that there is typically very little mixing action in such processes. The air swept tubular dryer of the present invention has been observed to be more efficient and typically has much higher production rates of processing materials than do the rotary drum or fluidized bed type processes. For example, the present invention is capable of removing 750 pounds of water for every 1000 CFM of air used in the process, at production rates of up to 50 tons per hour of material processed, with a retention time in the dryer in the range of approximately ⅓ to 4 minutes.

DETAILED DESCRIPTION OF THE INVENTION

Figure 1:
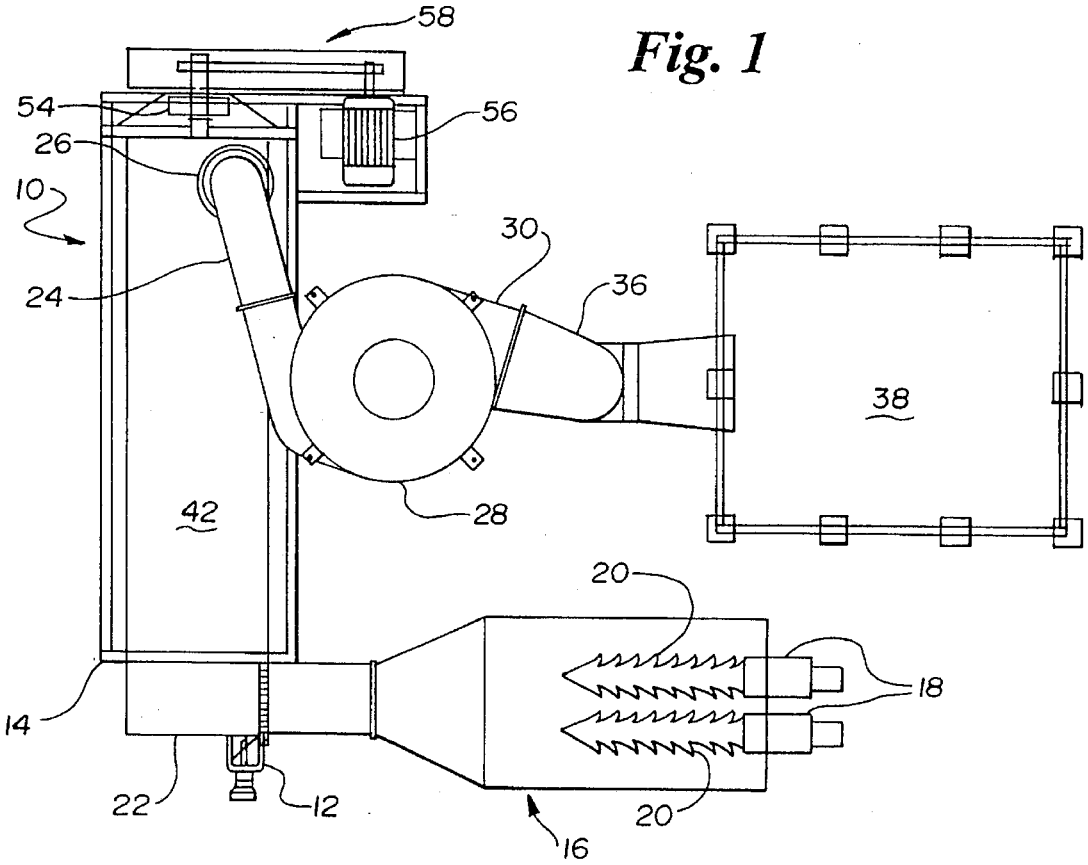
FIG. 1 is a plan view of an improved slurry dryer of the present invention along with auxiliary equipment.
Figure 2:
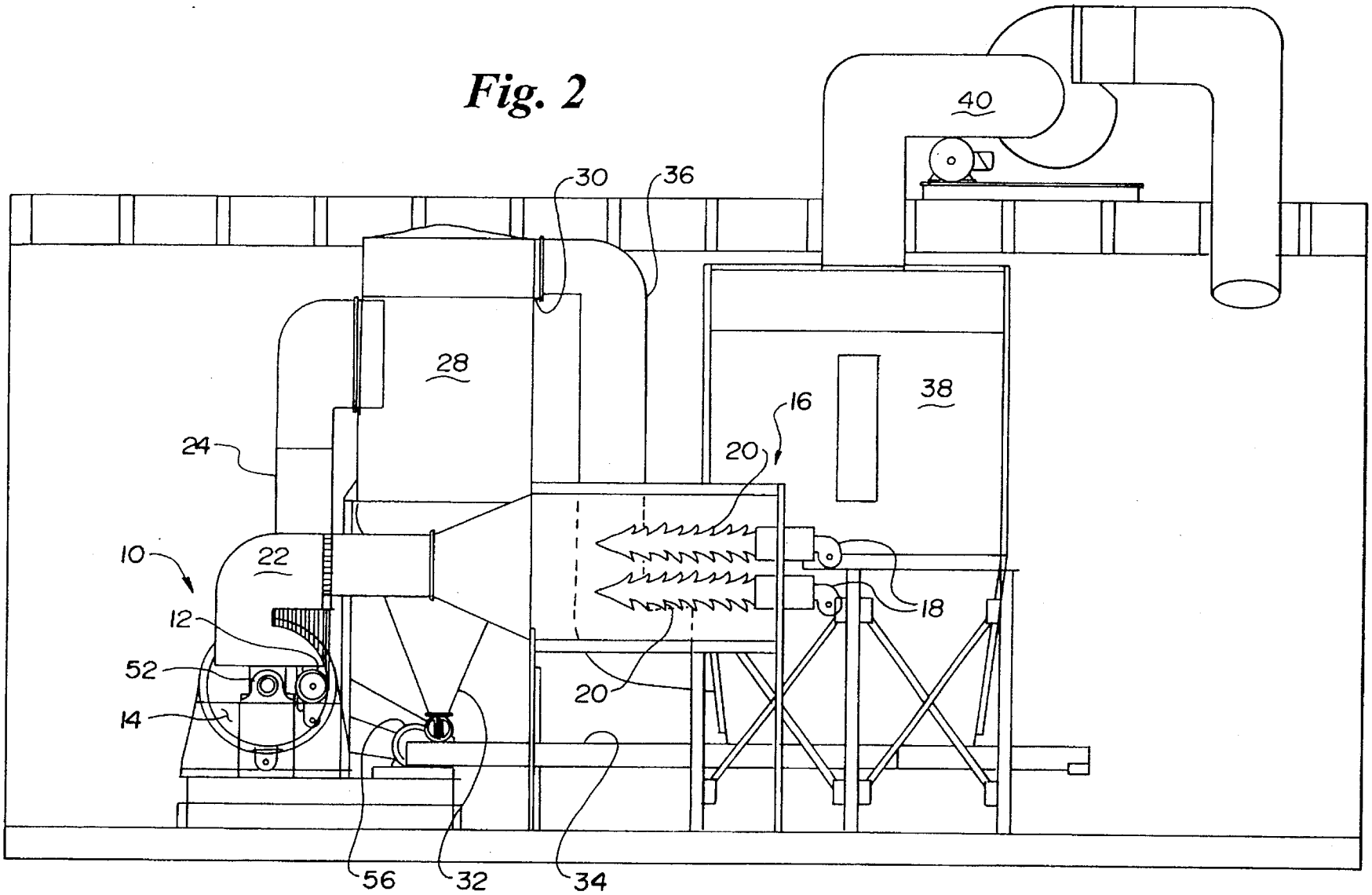
FIG. 2 is an end elevation view of the dryer and auxiliary equipment of FIG. 1.

Referring now to the Figures, and most particularly to FIGS. 1 and 2, an improved slurry dryer 10 may be seen, along with associated equipment useful in the practice of the present invention. The associated equipment typically includes a slurry feed pump 12 connected to an inlet end 14 of dryer 10 a source of hot air 16 which may include one or more blowers 18 and burners 20. The hot air is connected by an inlet air duct 22 to the inlet end 14 of dryer 10. An outlet duct 24 is connected between an outlet 26 of dryer 10 and a conventional cyclone separator 28. Separator 28 has an air outlet 30 and a material outlet 32. Material outlet 32 is preferably connected to a material delivery conveyor 34. Air outlet 30 is connected by a duct 36 to a dust collector 38. Once the air is filtered by dust collector 38, it may be exhausted to atmosphere via duct 40.

Figure 3:
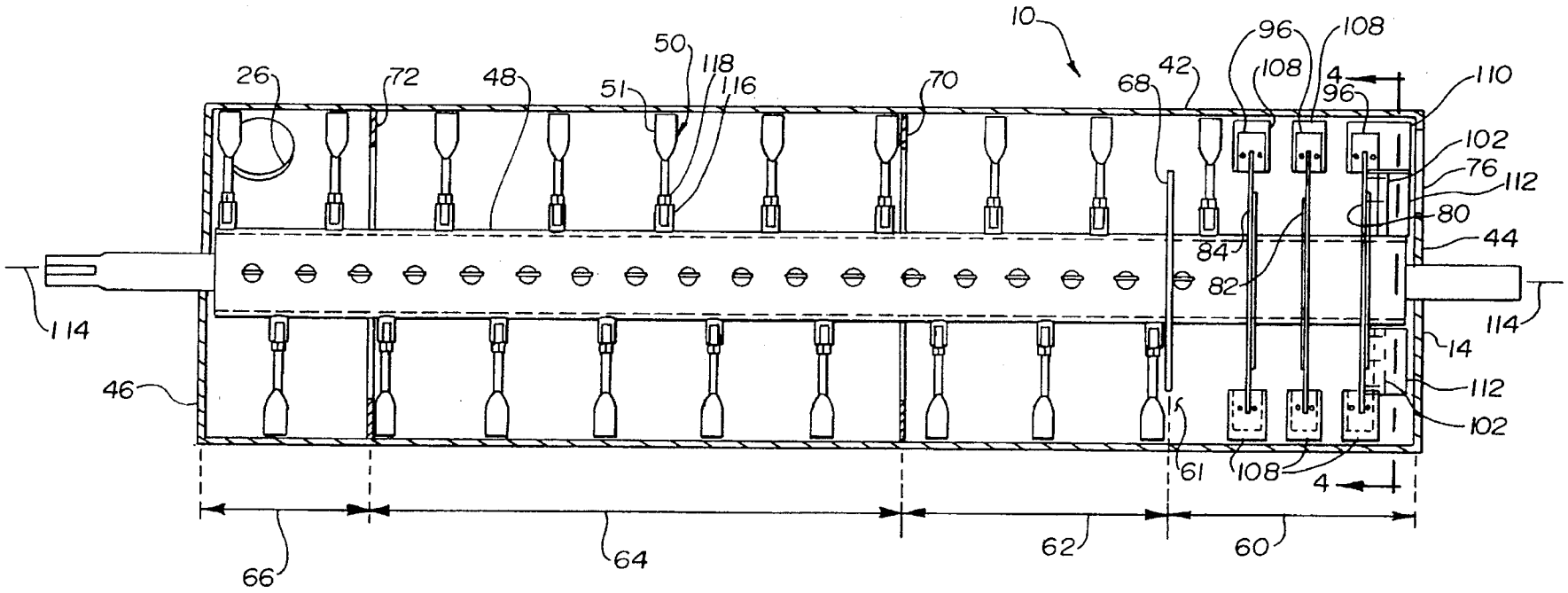
FIG. 3 is a side elevation view partly in section of the interior of the slurry dryer of the present invention.

Referring now also to FIG. 3, dryer 10 preferably includes a cylindrical housing forming a side wall 42, an inlet end wall 44, an outlet end wall 46, and a shaft 48. Shaft 48 preferably carries a plurality of beater blades 50, each of which may be forged to have a relatively flat portion (of about 1½ to 2½ inches wide, depending upon the size of the dryer) extending from a cylindrical base portion of about ⅞ to 1⅛ inches diameter.

Shaft 48 is preferably supported for rotation by a pair of pillow blocks 52, 54 (see FIGS. 1 and 2); and shaft 48 is driven by an electric motor 56 via a conventional pulley and drive belt arrangement 58.

Referring now again most particularly to FIG. 3, the dryer 10 preferably has an inlet portion 60, a free-flow generating section 62, a retention zone 64, and a discharge zone 66. The inlet portion 60 extends from inlet wall 44 to a shaft mounted air dam 68. The free flow generating section 62 extends from shaft mounted air dam 68 to housing mounted material dam 70. The retention zone 64 extends between the housing mounted material dam 70 and a similar material dam 72. The discharge zone 66 extends from dam 72 to outlet end wall 46. In the embodiment shown, with a cylindrical housing having a diameter of 30 inches and length of 120 inches, the shaft mounted air dam 68 is preferably located approximately 26 inches from the inlet end wall 44; the first housing mounted dam 70 is preferably mounted approximately 53 inches from wall 44; and the second housing mounted dam 72 is preferably mounted approximately 103 inches from inlet end wall 44. It is to be understood that with certain materials, one or more additional housing mounted dams may be used to control the flow of material in dryer 10. The beater blades 50, together with dams 70, 72 control the retention time of material in the housing and it is to be understood that beater blades 50 are adjustable and replaceable. It has been observed that the beater blades give intense mixing action in housing 42 to break up lumps and accomplish considerable size reduction as the slurry is processed by dryer 10. Material exiting dryer 10 may have a moisture content of about 10% or less, even though it enters dryer 10 at a moisture content of up to about 90 percent. As may be seen in FIG. 3, dryer 10 preferably has three agitator disk or scraper blade assemblies 80, 82, 84. It is to be understood that, depending upon the material to be dried, one or more scraper blade assemblies identical to assembly 84 may be mounted on shaft 48, upstream of air dam 68.

Figure 4:
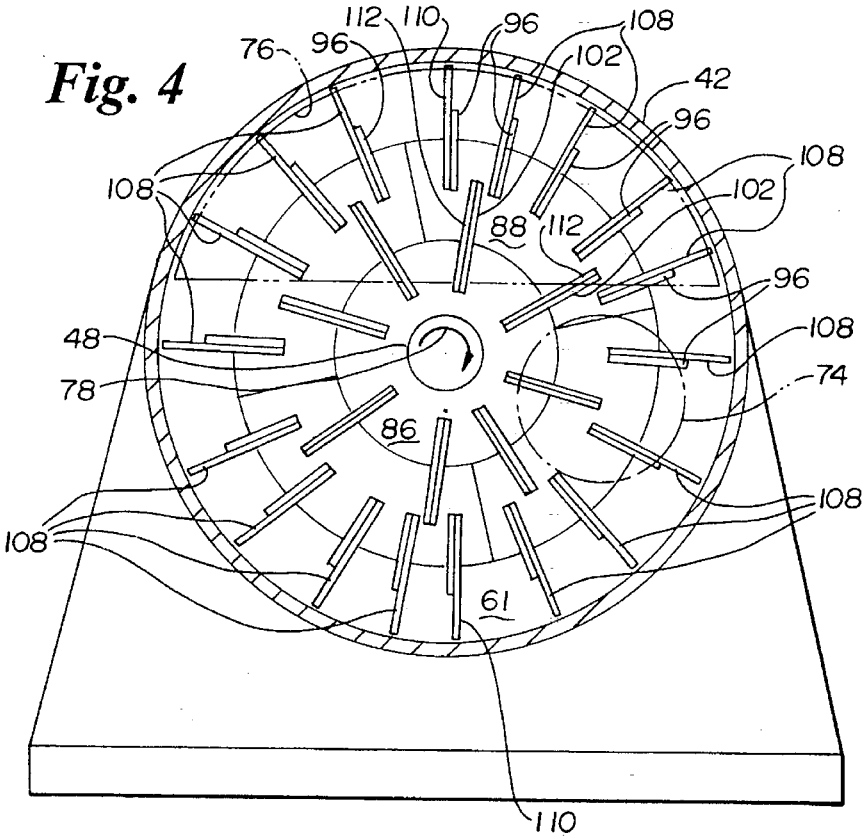
FIG. 4 is a simplified end view of the interior of the slurry dryer of the present invention taken along line 4—4 of FIG. 3 and showing an agitator disk assembly in plan view.
Figure 5:
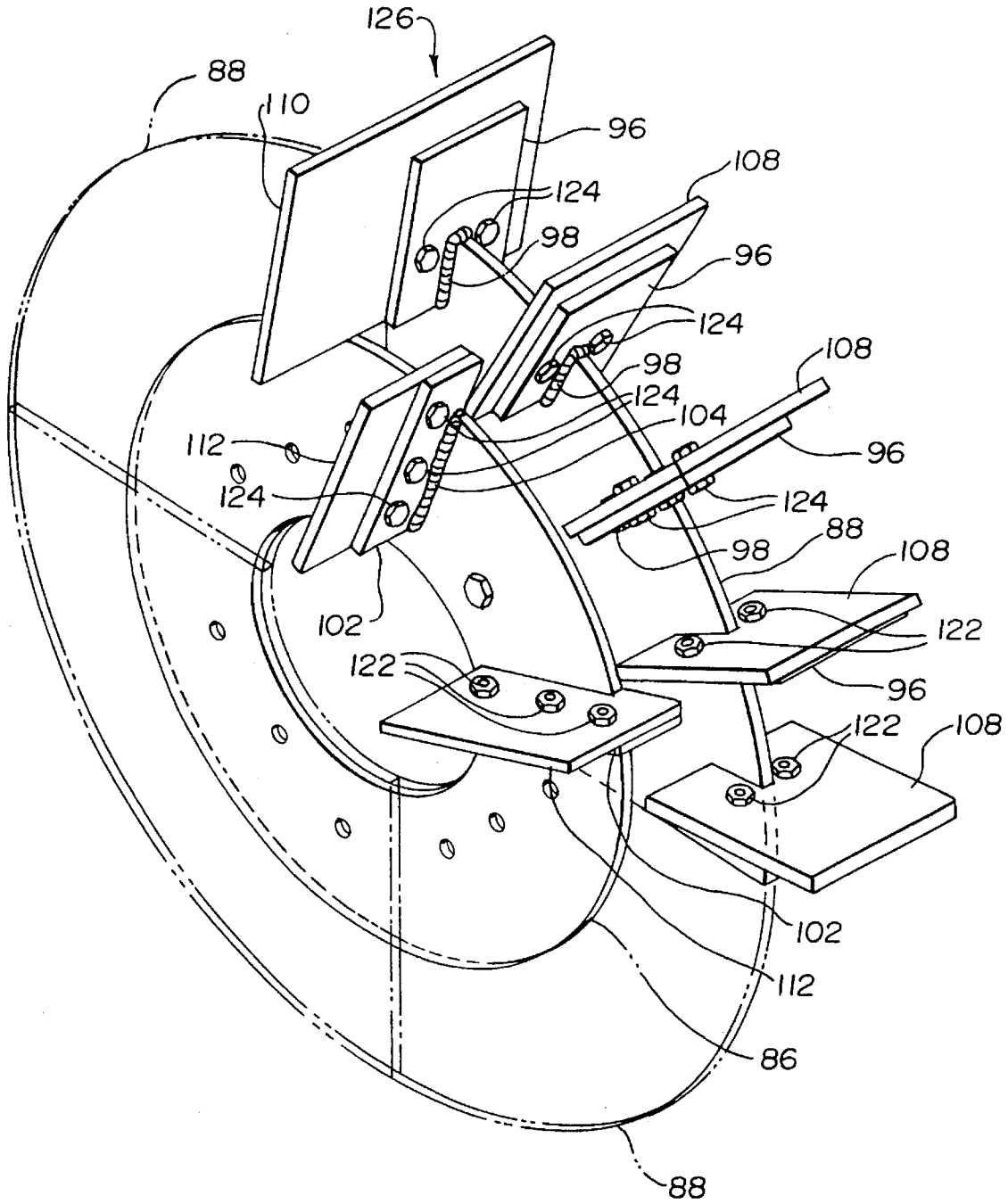
FIG. 5 is a perspective view of the agitator disk assembly of FIG. 4.
Figure 6:
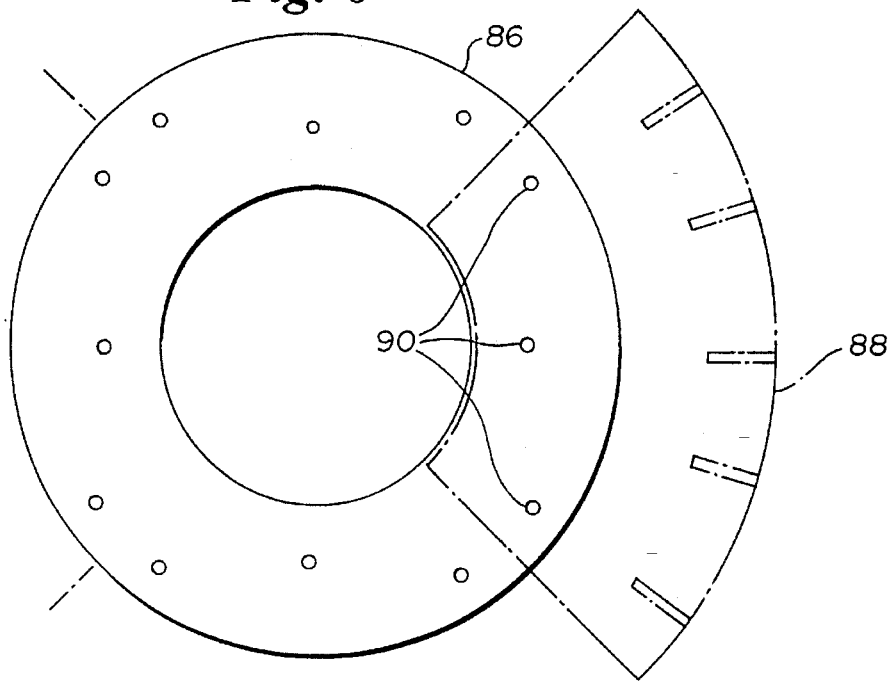
FIG. 6 is an enlarged plan view of a hub of the agitator disk assembly with a quadrant of the agitator disk shown in phantom.
Figure 7:
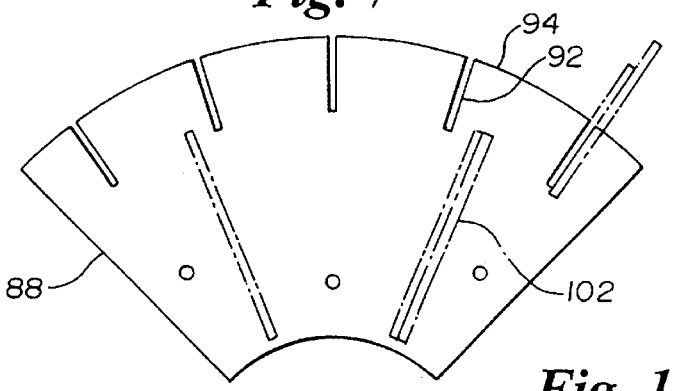
FIG. 7 is an enlarged plan view of a quadrant of the agitator disk with end and side wall scrapers and their supports shown in phantom.
Figure 8:
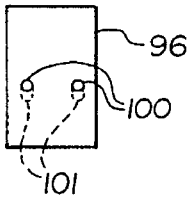
FIG. 8 is a plan view of a cylindrical wall scraper blade support.
Figure 9:
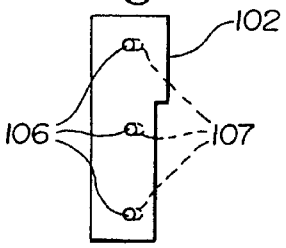
FIG. 9 is a plan view of an end wall scraper blade support.
Figure 10:
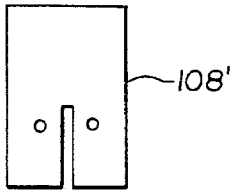
FIG. 10 is a plan view of a cylindrical wall scraper blade.
Figure 11:
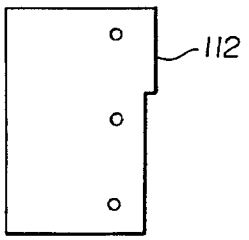
FIG. 11 is a plan view of an end wall scraper blade.
Figure 12:
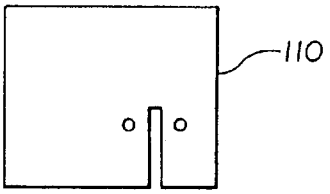
FIG. 12 is a plan view of a combined end and cylindrical wall scraper blade.

Referring now also to most particularly to FIGS. 4 and 5, (but also to FIGS. 6–12) details of the agitator disk or scraper blade support assemblies may be seen. Assemblies 82, 84 are preferably identical to each other and very similar to assembly 80, which differs in that it has additional and different scraper blades to remove material from end wall 44 as well as from the cylindrical side wall 42. Each scraper blade assembly has a central ring 86 supporting four identical quadrants 88. Ring 86 and quadrants 88 are preferably formed of ½ inch thick carbon steel and have mating holes or apertures 90 for securing quadrants 88 to ring 86, as may best be seen in FIGS. 6 and 8. Each quadrant 88 preferably has five radially oriented notches 92 at an outer circumferential periphery 94. Each notch 92 is preferably sized to receive a blade support 96, which may be welded (as at 98) to quadrant 88. Each blade support 96 (as shown in FIG. 8) preferably has a pair of holes or apertures 100 therein. The disk assembly 80 also preferably has four end wall scraper blade supports 102, two of which are shown in FIG. 5, and the position of which are shown in FIG. 7. Each end wall scraper blade support 102 is preferably secured to central ring 86 by a bead weld 104. As may be seen most clearly in FIG. 9 supports 102 each preferably have a plurality of holes or apertures 106 therethrough. Supports 96 and 102 are each preferably formed of ⅜ inch thick carbon steel. Support 96 may be 5 inches wide by 7½ inches long (in the radial direction); while support 102 may be about 12 inches long by about 2 inches wide, with a step along one side to mate with the step formed by the assembly of ring 86 and quadrant 88.

Preferably twenty cylindrical side wall scraper blades 108 are used on assemblies 82 and 84, and eighteen cylindrical side wall scraper blades are used on assembly 80. Assembly 80 further preferably has two combined end wall and cylindrical side wall scraper blades 110, in addition to eight end wall scraper blades 112. As may be seen in FIGS. 10, 11, and 12, each of blades 108, 110, and 112 has mating apertures to mount the blades to their respective supports or mounting means 96, 102, (for example, by conventional fasteners such as nuts 122 and bolts or machine screws 124) as may be seen most clearly in FIG. 5. Blades 108, 110, and 112 are preferably made of ¼ inch thick hardened steel or may be partially or entirely made of another hard material such as carbide for wear resistance. It is also to be understood that one of the sets of apertures in the scraper blades or the mounts may be elongated slots 101, 107 (shown by way of example at apertures 100, 106) to permit adjustment of the blades for dimension tolerance variations and for wear of the blades resulting from drying abrasive slurries.

Figure 13:
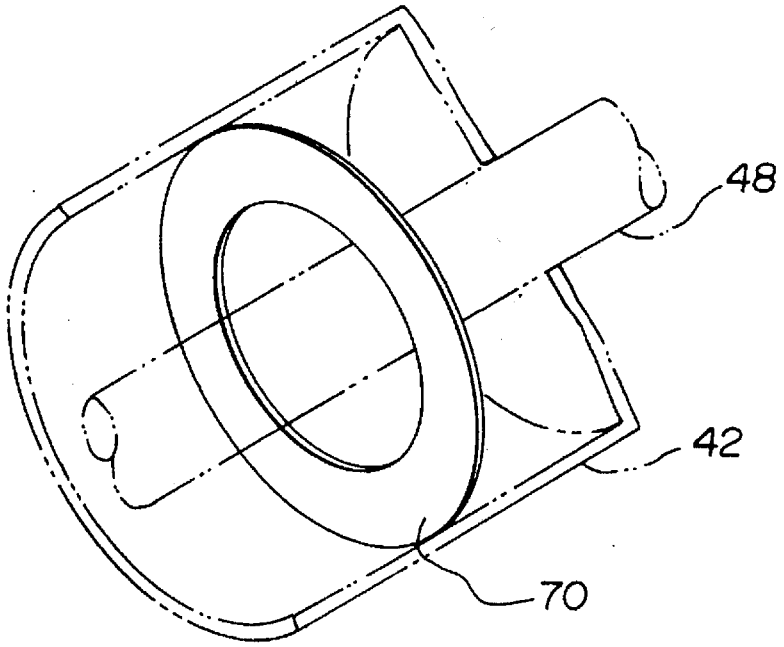
FIG. 13 is a perspective view of a side wall mounted dam with a portion of the cylindrical side wall and shaft shown in phantom.

Referring now also to FIG. 13, the side 10 wall mounted dam 70 is preferably a sheet metal toroid secured to cylinder by any conventional means such as welding. Dams 70 and 72 are each preferably ½ inch carbon steel with a radial dimension of 4 inches in the embodiment shown.

Figure 14:
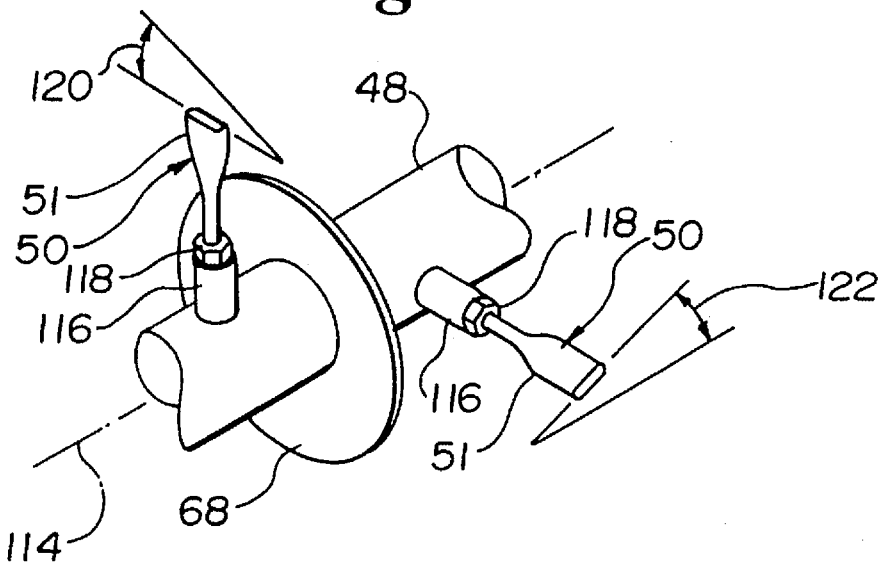
FIG. 14 is a perspective fragmentary view of a portion of the shaft assembly showing a shaft mounted air dam and a pair of beater blades.

Referring now to FIGS. 14 and 3, the shaft mounted air dam 68 (which may be fabricated of ⅜ inch thick carbon steel in sections such as quadrants and bolted together) preferably extends radially from the center of shaft 48 a distance of 23 inches to provide a 4 inch radial clearance between dam 68 and cylindrical side wall 42.

In FIG. 3, all of the beater blades 50 are shown aligned with the axis 114 of shaft 48. It is to be understood, however that each beater blade is preferably threaded and received in a threaded bore in sleeve 116, with sleeve 116 preferably welded to shaft 48. A nut 118 is received on the threaded portion of each beater blade 50 to lock the beater blade in a desired orientation with respect to either the plane of the shaft mounted air dam 68 (as indicated by angle 120) or with respect to the axis 114 of shaft 48 (as indicated by angle 122). It is to be understood that the angles 120, 122 of the beater blades 50 are fully adjustable, with angles between zero and ±90 degrees resulting in orientation of the beater blades to advance (for + angles) the slurry from inlet to outlet or to retard (using – angles) movement of the slurry through the dryer. By adjusting the ± sense of the beater blade angles in each of the portions or zones 60–66 of the dryer 10, the retention time of the slurry in that zone can be controlled. It is to be further understood that the beater blades between the air dam 68 and the first material dam 70 form a first group of beater blades, while the beater blades between the first and second material dams 70, 72 form a second group of beater blades. A third group of beater blades is located between the second material dam 72 and the outlet end wall 46. In addition, as shown in FIG. 3, additional beater blades may be located in the inlet portion 60, along with the scraper assemblies to aid in the mixing and drying process.

The operation of the dryer is as follows. Air is heated by burners 20 to an appropriate temperature (for example 1200° F. is preferable for high moisture content slurries, while 500° F. may be desirable for lower moisture content slurries) and directed by blowers 18 through duct 22 to air inlet 76 in inlet end wall 44 where it enters the interior of cylindrical housing 42 by forced convection. The slurry to be dried is urged into the inlet portion 60 of dryer 10 by feed pump 12 connected to slurry or material inlet aperture 74 in inlet end wall 44. Motor 56 drives shaft 48 to rotate at a speed appropriate to both the material to be dried and the size of dryer 10, typically within the range of about 250 to 750 RPM. In the embodiment shown with a 30 inch diameter housing, a typical speed for shaft 48 would be 500 RPM.

An inlet scraper blade assembly 126 including scraper blades 108, 110, 112 is located on shaft 48. The scraper blades 108, 110, 112 are preferably mounted to provide about ¼ to ½ inch clearance to the end wall and about ½ to 1 inch clearance to the cylindrical side wall, depending upon the slurry material, the moisture content, and the size of the dryer 10. The inlet scraper blade assembly also includes central ring 86 and quadrants 88 which together act as an inlet blade support structure.

Once the slurry enters the housing 42, the side and end wall scraper blades prevent it from building up on the interior of the side wall and end wall in the inlet region or portion 60 of dryer 10. Agitator disk assemblies 80, 82, and 84 stir or agitate the slurry in inlet portion 60 which is to be understood to be a "wet" zone within dryer 10.

The slurry is exposed to the heated air in region 60, and is it is believed that a certain amount of "flash drying" occurs in zone 60. Incoming slurry will urge material already present in inlet zone 60 to move towards the "free-flow generating" zone 62. Gravity will cause the slurry to remain in a lower region of inlet zone 60, and the shaft mounted air dam 68 will force the air to pass through a toroidal shaped opening 61 between dam 68 and the housing side wall 42. Air dam 68 thus forces the air to remain in contact with the slurry as it exits zone 60 and passes to zone 62.

Once in zone or section 62, the beater blades break up the material which is typically in a lumpy, wet state in this region of the dryer 10. Once the drying solids of the slurry reach about 50% moisture (from a 90% initial moisture), the drying solids pass over dam 70 and into the retention zone 66, typically aided by + angle beater blades 50 located in the inlet and free-flow generating zones 60, 62.

Some or all of the beater blades 50 located in the retention zone 64 are positioned to–angles to retain the drying solids in that zone until the moisture content is typically 15 to 20 per cent.

As the solids dry, they are carried by the air stream flowing through dryer 10 to and out of 10 discharge zone 66 via outlet 26. It is to be understood that one or more additional outlets may be provided at the side or bottom of cylindrical housing 42 to aid in separating solids of varying densities.

In the embodiment shown, relatively dry (e.g. 10% or less moisture content) solids are transported as a powder via air exiting outlet 26 (which may now be at, for example, 200° to 250° F.) to cyclone separator 28. The solids may typically be at a temperature of 125° to 175° F. as they exit housing 42.

The invention is not to be taken as limited to all of the details thereof as modifications and variations thereof may be made without departing from the spirit or scope of the invention.

What is claimed is:

1. An improved air swept tubular single pass slurry dryer of the type having a plurality of beater blades carried on a centrally located shaft in a cylindrical housing, the improvement in combination therewith comprising:

a) an air inlet aperture located at an inlet end of the cylindrical housing for admitting forced convection air at an elevated temperature into the housing;

b) an inlet scraper blade assembly located immediately adjacent the inlet end of the cylindrical housing and having i) an inlet scraper blade support carried by the shaft in an inlet region of the slurry dryer, ii) at least one end wall scraper blade rigidly carried by the inlet scraper blade support and positioned adjacent an inlet end wall of the housing, iii) at least one side wall scraper blade rigidly carried by the inlet scraper blade support and positioned adjacent a cylindrical side wall of the housing, c) a radially projecting air dam mounted on the shaft downstream of the inlet scraper blade assembly to direct the air radially outward and towards the slurry material to be dried; wherein the side wall scraper blades and the end wall scraper blades are each positioned to rotate in a fixed relationship with the shaft to prevent buildup of material on the inside of the cylindrical housing in the inlet region thereof and the air dam forces the air to remain in contact with the slurry material as it leaves the inlet region of the dryer.

2. A method of drying a high liquid content slurry in a continuous flow process comprising the steps of:

a) injecting a high liquid content slurry material to be dried into a cylindrical housing by passage through a material inlet aperture in an inlet end wall of the housing;

b) rotating a shaft concentrically located in the housing wherein the shaft has at least one inlet disk located on and rigidly mounted for rotation therewith in an inlet region of the housing adjacent the inlet end wall;

c) scraping an interior of the inlet end wall of the housing by at least one end wall blade rigidly mounted on a side of the inlet disk to prevent buildup of the slurry material on the inlet end wall; and d) scraping an interior of the cylindrical housing in the inlet region by at least one side wall blade rigidly mounted on the periphery of the inlet disk to prevent buildup of the slurry material on the side wall of the housing in the inlet region thereof.

3. The method of claim 2 wherein the end wall blade is removably mounted on the disk.

4. The method of claim 2 wherein the side wall blade is removably mounted on the disk.

5. The method of claim 2 wherein the end wall blade is adjustably mounted to the disk for limited axial movement to permit adjustment of the clearance between the end wall blade and the inlet end wall.

6. The method of claim 2 wherein the side wall blade is adjustably mounted to the disk for limited radial movement to permit adjustment of the clearance of the side wall blade and the cylindrical side wall of the housing.

7. The method of claim 2 further comprising e) admitting heated, force-convected air to the interior of the cylindrical housing through an air inlet aperture in the inlet end wall of the housing.

8. The method of claim 7 further comprising f) directing the air to a toroidal-shaped opening adjacent the cylindrical housing side wall and radially outward of a concentric air dam as the air leaves the inlet region of the dryer.

9. The method of claim 8 further comprising mixing the material with a first group of beater blades downstream of the air dam.

10. The method of claim 9 further comprising causing the material to move radially inward as it moves downstream by locating a first radially inwardly extending material dam in the cylindrical housing downstream of the first group of beater blades.

11. The method of claim 10 further comprising retaining the material temporarily in the housing in a retention region between the first radially inwardly extending material dam and a second radially inwardly extending material dam by mixing the material and directing it in an upstream direction by a second group of beater blades, the second group of beater blades located in the retention region between the first and second material dams.

12. An improved air swept tubular single pass slurry dryer of the type having a plurality of beater blades carried on a centrally located shaft in a cylindrical housing, the improvement in combination therewith comprising:

a) a plurality of scraper blade support disks with an inlet scraper blade disk located immediately adjacent the inlet end of the cylindrical housing, wherein all of the scraper blade disks are rigidly secured to and carried by the shaft at an inlet region of the slurry dryer;

b) a plurality of removable cylindrical wall scraper blades rigidly mounted to and spaced about the periphery of each scraper blade support disk;

c) a plurality of removable end wall scraper blades rigidly mounted to and spaced around a side of the inlet scraper blade support disk facing an inlet end wall of the cylindrical housing of the dryer; wherein the cylindrical wall scraper blades and the end wall scraper blades are each positioned to rotate in a fixed relationship with the shaft to scrape the wall adjacent thereto to prevent buildup of material on the inside of the end and cylindrical walls of the cylindrical housing in the inlet region thereof.

13. The slurry dryer of claim 12 further comprising a plurality of scraper blade support means permanently secured to each scraper blade support disk for removably and adjustably mounting the cylindrical wall scraper blades to the scraper blade support disk.

14. The slurry dryer of claim 13 wherein the means for removably and adjustably mounting the cylindrical wall scraper blades to the inlet scraper disk comprises a plurality of mounting plates secured to the disk, each at a right angle thereto and each having a set of holes therein aligned with a set of holes in each of the blades and wherein one of the sets of holes is elongated to permit adjustment of the blade radially toward and away from the disk.

15. The slurry dryer of claim 14 further comprising at least one combined end wall and cylindrical wall scraper blade mounted to one of the scraper blade support means on the scraper blade disk adjacent the inlet end wall for scraping slurry material from a region where the inlet end wall and cylindrical side wall intersect in the cylindrical housing.

16. The slurry dryer of claim 13 wherein the scraper blade support means on the inlet scraper blade disk further includes means for removably and adjustably mounting the end wall scraper blades to the inlet scraper blade disk.

17. The slurry dryer of claim 15 wherein the means for removably and adjustably mounting the end wall scraper blades to the inlet scraper disk comprises a plurality of mounting plates secured to the disk, each at a right angle thereto and each having a set of holes therein aligned with a set of holes in each of the blades and wherein one of the sets of holes is elongated to permit adjustment of the blade axially toward and away from the end wall.

18. The slurry dryer of claim 12 further comprising a plurality of beater blades carried by and extending radially from the shaft downstream of the scraper blade support disks wherein the each beater blade has a relatively flat portion adjustable within a range of angles relative to an axis of the shaft.

19. The slurry dryer of claim 18 further comprising an air dam in the form of a radially extending disk mounted to the shaft downstream of the scraper blade support disks and operative to direct air radially outwardly of the disk and through a toroidal shaped opening between the air dam and the cylindrical side wall.

20. The slurry dryer of claim 19 still further comprising a first material dam mounted to and extending radially inward of the cylindrical housing intermediate a firs and a second group of beater blades located downstream of the first group to control the flow and retention time of material in the housing.

21. The slurry dryer of claim 20 still further comprising a second material dam mounted to and extending radially inward of the cylindrical housing intermediate the second and a third group of beater blades with the third group of beater blades located downstream of the second group to temporarily retain material in the housing between the first and second material dams.

22. The slurry dryer of claim 21 wherein a plurality of beater blades in the second group are each adjusted to an angle relative to the axis of the shaft to direct the material in the housing in an upstream direction such that material is retained temporarily in the region between the first and second material dams.

23. The slurry dryer of claim 22 wherein a plurality of beater blades in the first group are adjusted to an angle relative to the axis of the shaft to direct material in the housing in a downstream direction such that material is advanced in the region between the air dam and the first material dam.

24. The slurry dryer of claim 23 wherein a plurality of beater blades in the third group are adjusted to an angle relative to the axis of the shaft to direct material in the housing in a downstream direction such that material is advanced in the region downstream of the second material dam.

* * * * *

UNITED STATES PATENT AND TRADEMARK OFFICE

CERTIFICATE OF CORRECTION

PATENT NO. : 5,570,517
DATED : November 5, 1996
INVENTOR(S) : William A. Luker

It is certified that error appears in the above-indentified patent and that said Letters Patent is hereby corrected as shown below:

Col. 8, line 7, delete "firs" and insert -- first --.

Signed and Sealed this

Eighteenth Day of February, 1997

*Attest:*

*Attesting Officer*

BRUCE LEHMAN

*Commissioner of Patents and Trademarks*